US006165316A

United States Patent [19]

Iivonen et al.

[11] Patent Number: 6,165,316

[45] Date of Patent: Dec. 26, 2000

[54] METHOD AND PLANT FOR SEPARATING SOAP FROM BLACK LIQUOR USING A PRESSURE SCREEN

[75] Inventors: Mauno Iivonen, Pulp; Kari Koskinen; Jarl Kurkio, both of Kotka; Hannu Ramark, Pulp; Esko Turunen, Jouisano, all of Finland

[73] Assignee: Andritz-Ahlstrom Oy, Espoo, Finland

[21] Appl. No.: 09/171,877

[22] PCT Filed: May 6, 1997

[86] PCT No.: PCT/FI97/00273

§ 371 Date: Jan. 12, 1999

§ 102(e) Date: Jan. 12, 1999

[87] PCT Pub. No.: WO97/42371

PCT Pub. Date: Nov. 13, 1997

[30] Foreign Application Priority Data

May 7, 1996 [FI] Finland ..... 961930

[51] Int. Cl.[7] ..... D21C 11/00

[52] U.S. Cl. ..... 162/16; 162/29; 162/55; 162/239

[58] Field of Search ..... 162/16, 29, 55, 162/239

[56] References Cited

U.S. PATENT DOCUMENTS

| | | | |
|---|---|---|---|
| 2,186,295 | 1/1940 | Hasselstrom | 92/90 |
| 3,109,839 | 11/1963 | Keith | 260/97.7 |
| 4,058,433 | 11/1997 | Fuller | 162/16 |
| 4,495,095 | 1/1985 | Lawson et al. . | |
| 5,164,480 | 11/1992 | Huibers et al. | 530/208 |

*Primary Examiner*—Dean T. Nguyen
*Attorney, Agent, or Firm*—Nixon & Vanderhye P.C.

[57] ABSTRACT

An alkaline cellulose pulp pulping process treats soap and fiber-containing liquids to separate fibers from the liquids prior to further treatment of the liquids (e.g. by evaporation and combustion, or by cooking to produce tall oil). Black liquor containing soap, and/or washer filtrate containing soap, are fed to one or more soap separating tanks, and then the soap fraction from the top of the tanks is fed to a pressure screen where fiber separation takes place (preferably at a temperature of at least 70° C.). Black liquor may be added to the soap fraction to dilute it, and preferably simultaneously raise its temperature. The pressure screen has a screen surface with holes of 0.4 mm diameter or less, or slots with a width of 0.2 mm or less.

20 Claims, 2 Drawing Sheets

METHOD AND PLANT FOR SEPARATING SOAP FROM BLACK LIQUOR USING A PRESSURE SCREEN

CROSS REFERENCE TO RELATED APPLICATION

This is a U.S. national phase of PCT/FI97/00273.

BACKGROUND AND SUMMARY OF THE INVENTION

The present invention relates to a method and apparatus for intensifying an alkaline pulping process according to which at least soap-containing spent liquors from digestion and soap-containing washing filtrates from brown stock washing are recirculated in the digester house, the brown stock washing plant or between these. The invention relates in particular to treatment of at least the soap fraction separated from liquors and filtrates in order to separate fiber material therefrom.

In a chemical alkaline pulping process, lignocellulose-containing material, such as wood chips, is treated by digesting it in a solution the active chemicals of which are mainly sodium sulphide and sodium hydroxide, or sodium hydroxide alone. After digestion, spent liquor is separated from the pulp which is carried to further treatment such as washing, screening and bleaching. Chemicals are recovered from the spent liquor, i.e. black liquor, for production of fresh cooking solution.

During the digestion process, greases and resin acids of wood saponify and form sodium soaps, sulphate soap. Conventionally, soap is separated from black liquor prior to feeding the liquor to evaporation and combustion to form green liquor and further white liquor. As soap is lighter than liquor it rises to the surface and is readily decanted off. It is important to remove soap as fully as possible because it is a strong scummy substance and thus causes many problems in the process. However, it should be noted that part of the soap has been dissolved into the black liquor and thus it is not separated to the surface of the liquor.

In addition to the digestion, soap is transferred from the pulp to the liquor also during washing of the pulp. The solubility of soap is different from that of other dry solids and thus it may not be as easily washed as other dry solids. In filter washing, soap is removed from the pulp at a later stage than other dry solid. Foaming soap also hampers filter washing of pulp.

As known, chemical pulp may be produced by an alkaline cooking process both in batch digesters and in continuous digesters. Instead of always feeding the black liquor from the digester to recovery of chemicals, hot black liquor may be used to pretreat wood chips before the digestion stage itself in order to improve the process. In a continuous digestion, hot black liquor may be recirculated to pretreat wood chips in the impregnation stage as has been described for example in EP patent no. 527 294. Hot, pressurized black liquor may also be flashed to produce steam and to raise the dry solids content of the black liquor. In batch digestion, black liquor may be stored at different temperatures in liquor tanks, "liquor batteries", for use in a pretreatment of chips.

Recirculation of black liquor provides several advantages. For example, the heat economy of the process is improved and, when sulphur is present in the digestion, black liquor augments the volume of sulphur compounds in the cellulose pulp which in the impregnation stage have a very favourable influence of decreasing the Kappa number of the pulp.

Recirculation of black liquor brings about problems, also, as the soap contained in the black liquor accumulates in the process if it is not efficiently removed from the solutions recirculated.

Efficient removal of soap in the processes described above has not been paid necessary attention to before. EP patent application no. 520 452 discloses a method having three tanks for black liquor. At the beginning of displacement with washing filtrate, which takes place after digestion, black liquor is introduced into a first hot liquor battery essentially at the cooking temperature and pressure and at the dry solids content reached during the digestion. Black liquor, the temperature of which corresponds to the boiling temperature of liquor in an atmospheric pressure, is fed into a second black liquor battery. The dry solids content of the black liquor in the second battery is lower than that of the black liquor in the first battery because the black liquor mentioned first contains remarkable amounts of wash liquid and consequently also its soap content is higher. According to this EP publication, the second black liquor is used to heat the white liquor to be introduced into the digester and after that the black liquor is transferred to a tank in which soap is separated from it. Subsequently, the black liquor having a temperature of less than 100° C. is used to impregnate the chips of a new digestion batch. The chips are impregnated after that also with the hot black liquor from the first tank.

It has been noticed recently, however, that the measures of removing soap described above are not adequate. If soap is not removed efficiently enough from liquids reused, such as black liquor and washing liquids, soap will accumulate in the pulp in the digester and will dissolve from it during further treatment. When pulp is further removed from the digester to a blow tank and a brown stock washing, soap causing strong froth formation gives rise to problems in the blow tank and wash filters and thus causes production disturbances and decreases the pulp quality.

As described above, wood chips are conventionally treated in batch digestion today with black liquor before digestion of the chips with white liquor. Grounds for this are for example the advantages provided by the black liquor treatment, for example an improved energy economy. Naturally, this presupposes optimal operation of the process. Removal of soap from the solutions containing soap helps in reaching this goal. The soap content of the black liquor in a batch digestion depends on the spot of the displacement process in the digester from which the liquor is recovered. As described above, black liquor is discharged from the digester during the displacement at least to two tanks. The soap content of the black liquor increases when the wash filtrate introduced into the displacement process from brown stock washers is discharged from the digester. In Scandinavian circumstances, the soap content of pulp entering a brown stock washing department may be 80–100 kg/$t_m$. By regulating the soap content of the wash filtrate to be brought to the displacement, the soap volume ending up in the digester may be reduced as black liquor containing brown stock wash filtrate is typically used in the impregnation of the next digestion batch. Further, it is advantageous to remove soap from this black liquor before this impregnation. Also the soap content of the black liquor removed at the beginning of the displacement process may be reduced if desirable. All these measures may be used to reduce the soap amount entering the blow tanks and further the brown stock washing department with the pulp.

In continuous digestion, black liquor is recirculated to pretreatment, sludging and impregnation of chips. Black liquor is removed from the digester and, if desired, transferred to flash tanks before it is reused. The potential problems caused by soap may be avoided by controlling after the flash tanks the soap content of the black liquor to be used for pretreatment of chips.

When more efficient soap separation is pursued it should be kept in mind that fibers are separated both into black liquor and into wash filtrates which hamper evaporation of black liquor by fouling evaporator surfaces and thus reduce the efficiency of the process and in the worst case even interrupt the production. For this reason, prior art methods tend to separate fiber fraction from black liquor before evaporation thereof by a drum filter in which fiber fraction remains onto a wire surface of a filter drum while black liquor is filtered through a fiber layer and the wire surface and is pumped onward for further treatment, for example evaporation. A process of this kind has been disclosed for example in the PCT application no. WO 9303815. A drawback of these processes is that only a part of the black liquor is guided to recovery of chemicals while a large portion is returned for reuse for example in the impregnation of chips. Thus, it is quite unnecessary to separate fiber fraction from a liquor which in any case is returned to the digestion process.

Just as black liquor, also the soap fraction separated/to be separated from the liquors of a digestion plant and a wash plant contains fibers. Until now, fibers have not been separated from the soap fraction because mill experience has shown that a filter drum used in the filtering of fibers from black liquor is not applicable for this purpose. The composition of this fiber fraction is significantly different from that of black liquor. The soap fraction is a fluffy lumpy material separated from the surface of liquor for example in a separation tank as an overflow. If this fluffy lumpy fraction is distributed onto a drum filter in which a fiber mat is gradually formed onto a wire, it is clear that lumpy soap remains on the same side of the wire surface as the fiber mat and consequently only black liquor becomes separated from the fibers and soap. The separation of fibers from the soap fraction is further hampered by the fact that fibers travelling with the soap fraction are mostly attached to the soap lumps. When this kind of soap fraction is carried without separation of fibers to an evaporation plant the fiber fraction impedes the operation of the evaporator. Further, if the soap is used in the production of tall oil, the fiber fraction hampers the tall oil cooking process.

In U.S. Pat. No. 3,109,839 a process for production of organic acids has been diclosed. The process uses alkali soap skimmings from sulphate pulp manufacture as raw material for organic acids. The process includes treating the soap skimmings with both dispersing agents and mineral acids to decompose alkali metal soaps and to form organic acids and alkali metal and alkaline earth salts. After the decomposition of the soaps the reaction mass is transferred to a screen for separating fibers from the reaction mass. The process avoids the blockage of screen surfaces by means of breaking the soap molecules into smaller molecules which do not interfere with the fiber separation.

An object of the present invention is, among other things, to eliminate the problem mentioned and to provide a method of reducing the fiber content of soap-containing solutions discharged from a pulping process so that fibers do not cause problems in further treatment of the soap fraction or a combined fraction of soap and black liquor.

The characteristic features of the present invention developed for example to reach the object mentioned above are disclosed by the appended patent claims.

DETAILED DESCRIPTION OF THE DRAWINGS

Figure 2:
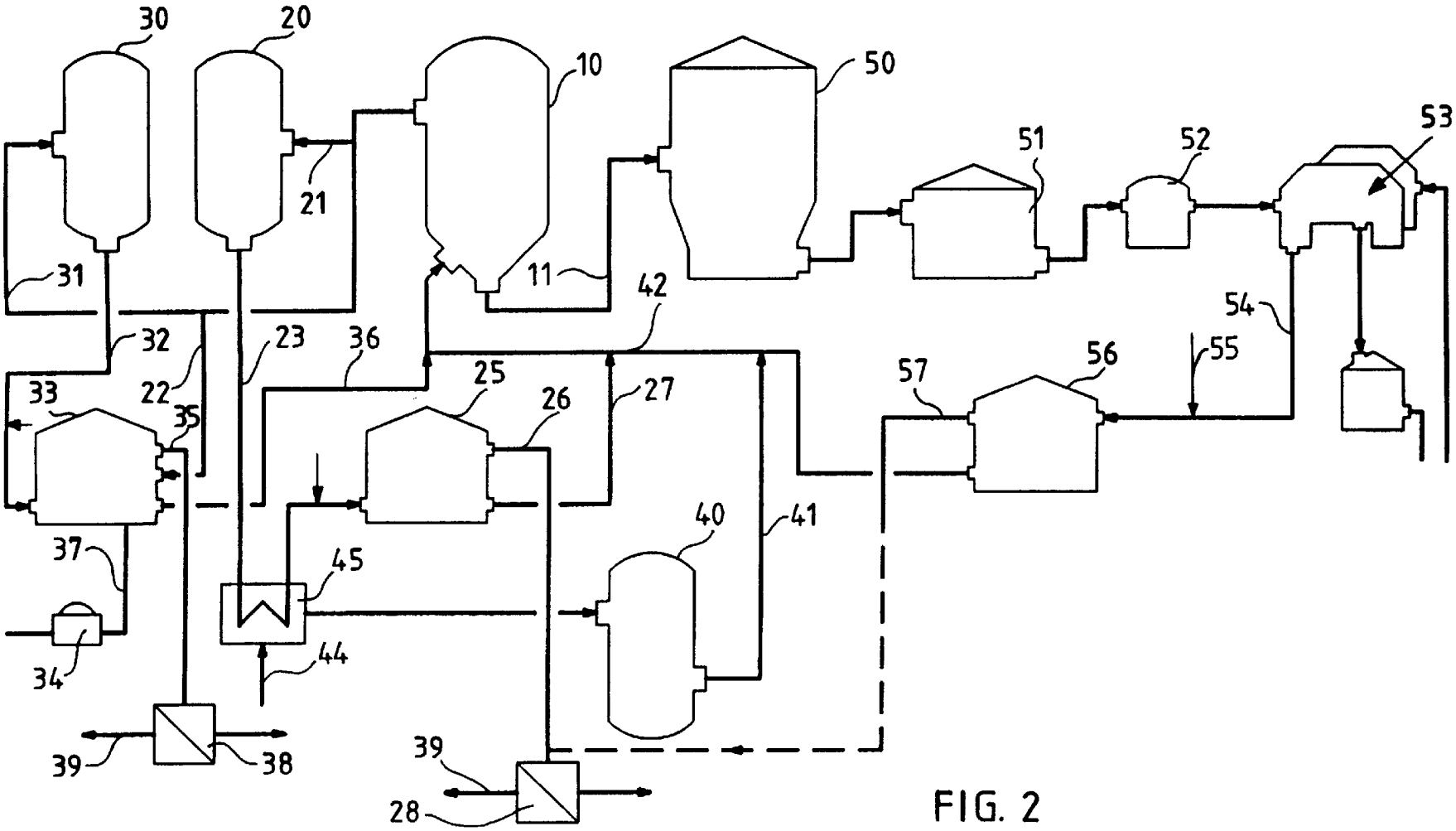
FIG. 2 illustrates schematically a preferred embodiment of the method of the invention applied in a batch digestion process.

In the process of FIG. 2, illustrating a process according to a preferred embodiment of the invention, a batch digester 10 has been charged with wood chips and white liquor supplied in lines 41 and 42 from a tank 40, for digestion. When the digestion performed at a raised temperature, at about 155–180° C., has been completed, black liquor produced during the digestion is discharged from the digester by displacing it with wash filtrate 54 obtained from brown stock washing 53. The hot black liquor discharged first is taken in line 21 to a hot liquor battery. The temperature in the hot liquor battery is almost the same as the cooking temperature.

The temperature of black liquor discharged from the digester 10 at a certain stage of the displacement process decreases as the temperature of the displacement liquor, i.e. of the wash filtrate 54, is less than 100° C. This liquor having a lower temperature is taken in line 31 to a second liquor battery 30. After the displacement, pulp is discharged in line 11 to a blow tank 50.

The black liquor in the batteries 20 and 30 may be reused to pretreat chips for the next digestion batch. The black liquor in the battery 30 having the lower temperature contains soap from brown stock wash filtrate and pulp and the soap has to be removed as completely as possible before the liquor is guided to heat the next chip batch in the digester 10. In practise this means that the amount of soap to be removed is the amount entrained in the black liquor from the wash filtrate and pulp. According to the invention, the liquor is guided for this purpose from the battery 30 in line 32 to a soap separating tank 33. The tank 33 has been dimensioned so as to provide an adequate retention time to allow soap, being a lighter substance than liquor, to be separated to the surface of the liquor. Soap may be removed by known soap separation methods by means of which soap can be skimmed off from the surface of the solution. The tank 33 may for example be provided with an over-flow for the soap fraction. Depending on the mill, soap is removed from the soap separation tank in line 35 for example either to tall oil production or evaporation and combustion. Essentially soap-free black liquor is taken in line 36 to the digester 10 to heat and impregnate chips. The black liquor supplied to the tank 33 contains also fibers which are not separated to any particular fraction but part of them remain in the soap-free black liquor and are drifted back to the digestion and part of them are transported further entrained in the soap fraction.

The heating and impregnation black liquor is displaced from the digester 10 by black liquor from the battery 20 and is discharged from the digester in line 22 to the tank 33 for separation of soap and farther in line 37 to a black liquor evaporation plant. As the black liquor in line 37 is essentially soap-free the line 37 may be provided with for example a cylinder-type filter 34 to separate fibers from the black liquor.

Figure 1:
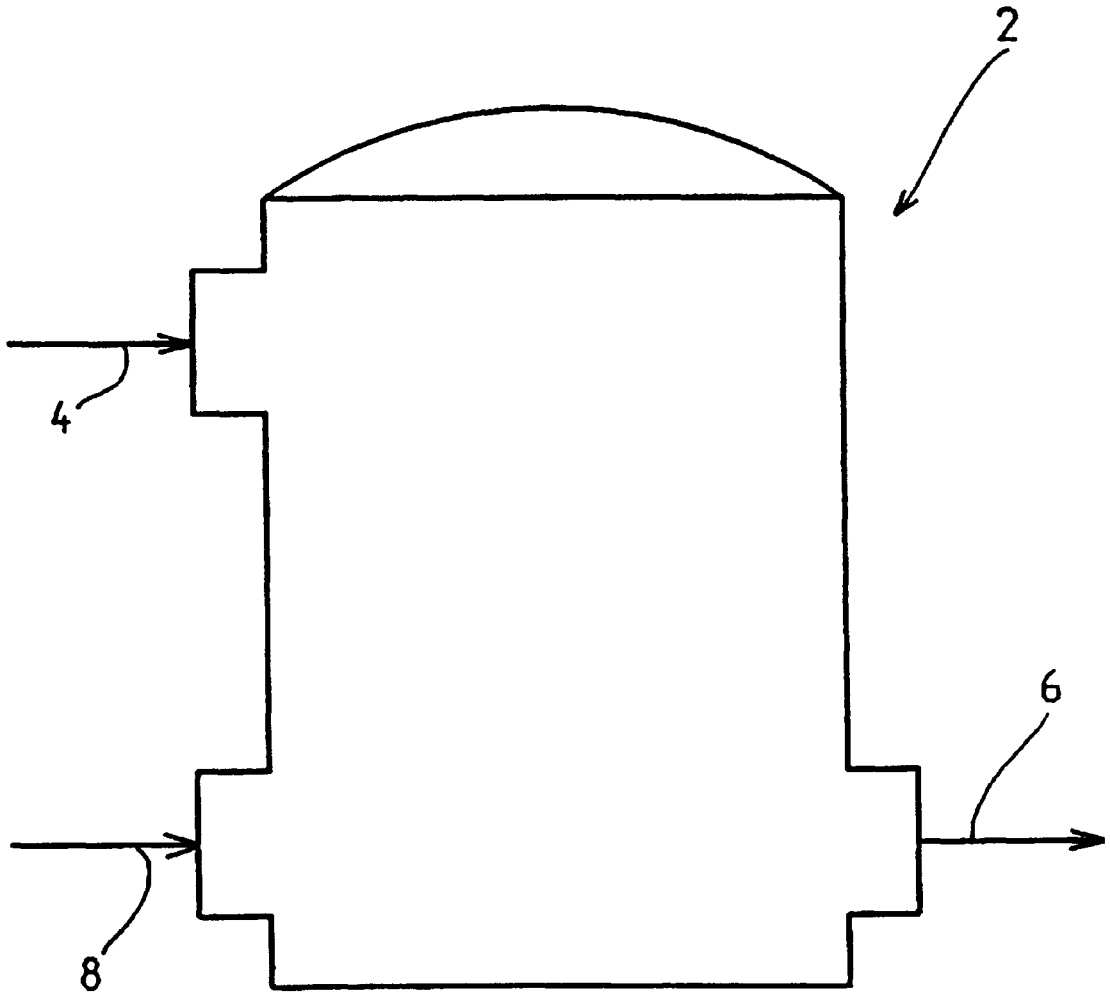
FIG. 1 illustrates schematically a pressure screen used in a preferred embodiment of the method of the invention.

According to the invention, the line 35 discharging fiber-containing soap fraction from the soap separation tank for example either to tall oil production or evaporation and combustion has been provided with a pump and a pressure screen 38 with which soap fraction is treated so that the screen rejects fibers in the soap and accepts soap itself and black liquor with it. In other words, fiber fraction is meant to be collected onto the screen surface and be removed therefrom for reuse while soap fraction passes through the fine apertures in the screen surface and is discharged from the apparatus in a line 39 for further treatment of soap. The pressure screen 38 (FIG. 1) used typically comprises a pressure-tight housing 2 and connections therein for the material to be fed in, reference number 4, for the fraction passed through the screen drum, i.e. the accept 6, and for the fraction which has remained on the surface of the screen drum, i.e. the reject 8. The housing surrounds a combination of a screen drum and a pulse member in which either the screen drum or the pulse member is rotating.

Usually the pulse member is a so-called rotor, i.e. a revolving means generating a turbulence field in the vicinity of the screen drum surface which on one hand prevents the screen drum apertures from being clogged and on the other hand, during normal operation of the screen, breaks up fiber lumps in the vicinity of the screen drum surface. For example U.S. Pat. No. 5,000,842 describes a typical pressure screen. In this type of use, the apertures in the screen drum of the screen 38 must be very small in order to reject fibers. When holes are used the diameter of the holes must be at the most 1.0 mm, preferably less than 0.5 mm, most preferably about 0.20–0.25 mm. When a slotted drum is used the width of the slots must preferably be at the most 0.20 mm. When the apparatus employs also a rotor generating a relatively strong turbulence, practical experience has proved that the turbulence breaks up soap lumps so that also fibers are detached from them and consequently soap, being a finer substance, passes through the apertures of the screen surface and fibers remain on the screen surface and are transported along the surface to the discharged opening of the screen.

A method according to a preferred embodiment of the present invention is characterized in that soap fraction is diluted with black liquor so that the share of the soap fraction is preferably less than 50% of the total dry-solids volume to be screened. Preferably the dilution is carried out with hot black liquor so that the temperature of the suspension in the screening process is higher than 60° C., preferably higher than 70° C.

When fiber fraction has been separated from both the essentially soap-free black liquor and the soap fraction, the soap and the black liquor may be combined and transported for further treatment.

Before hot black liquor from the battery 20 is guided to a digester, it also may be treated in a corresponding way as the cooler black liquor from the battery 30 in order to remove soap from it. The hot black liquor flowing in line 23 may at first be used to heat white liquor 44 in a heat exchanger 45. Soap is separated from the solution in a tank 25. Soap is discharged in line 26 and the hot black liquor having a low soap-content is pumped in lines 27, 42 to the digester to displace a cooler black liquor.

Quite in the way described above, fiber fraction may be separated in a pressure screen 28 also from a soap fraction obtained from the soap separation tank 25. Further, soap fractions from both the separation tanks 33 and 25 may be combined and treated in one and the same pressure screen in order to separate fibers from the soap fraction.

Following the digestion, pulp is supplied after a blow tank 50, a storage tank 51 and a potential knot separation 52 to a washing plant to brown stock wash filters 53. Large amounts of soap may be transferred from the pulp to the wash filtrate in the washers. When such wash filtrate is recirculated to a digester to be used as displacement liquid, soap will consequently accumulate in the pulp and soap, foaming heavily, will cause problems in the blow tank. Accumulation of soap may be prevented at this stage of the process by providing the process with a soap-separating tank 56 for treatment of the wash filtrate, the separated soap being discharged from the tank in line 57. Also this soap fraction may be treated either with a pressure screen of its own, or it be combined with the soap fractions described above (FIG. 2 illustrates an alternative of combining the soap fractions from displacement tanks 56 and 25 and treating them together in a pressure screen 28) whereby the process may manage with a minimum of one pressure screen for separating fibers from different soap fractions.

EXAMPLE

In a Finnish pulp mill, a pressure screen was connected to a device illustrated by reference numeral 38 in the figure. The operation of the pressure screen was monitored for several weeks by determining the fiber content (mg/l) in the feed, the accept and the reject of the pressure screen and the soap content (%) in the feed and reject of the pressure screen. The test in the first period was performed by using a screen drum with a hole diameter of 0.2 mm. It was proved that the mean separation efficiency during the test period was about 64%. The test in the second period was performed using a screen drum with a hole diameter of 0.4 mm. It was found out that the separation capacity was essentially poorer, i.e. about 14%. When the separation efficiency was tested using a higher fiber contents in the feed flow it could be stated that even a drum having "large holes" can reach a good separation efficiency, about 83%, when the fiber amount in the soap fraction is high. Further, the test proved that the soap content of the reject is about 70–75% of the soap content of the feed flow. This indicates that returning the fiber reject for reuse does not cause accumulation of soap in the return circulation but the apparatus works as it was expected to work.

As may be understood from the above, a method of a new type eliminating the drawbacks of prior art methods has been developed for improving the chemical recovery circulation of a pulping process, the method being mainly based on treating soap fractions from different partial processes as much without problems as possible. It should also be remembered that although the invention has been applied to a batch process as an alternative, the method according to the invention is in a quite corresponding way applicable to a continuous process in connection with which, too, the problems caused by soap and the fiber content of soap are known and admitted. Thus, according to the invention, soap may be separated from one or several soap-containing solutions of a continuous digestion process, or different soap-containing solutions may be combined and the soap-containing fraction may be removed from them and treated further in a pressure screen in order to separate fibers from the soap-containing fraction. Further, it is quite possible according to the invention to separate soap from soap-containing solutions by using some other means than the soap-separating tank described above. Thus, the method according to the invention described above may be applied to any other point of the pulp manufacturing process treating soap-containing fractions, for example a batch or a continuous digestion, a washing plant or an evaporation plant. Further, the soap fractions from different pulp production departments may be combined in a desired way and treated further in one or several pressure screens in order to separate fibers from the soap fraction.

We claim:

1. A method of treating an alkaline pulping process soap and fiber containing liquid downstream of a soap separator comprising: (a) separating fibers in the soap and fiber containing liquid from the liquid in a pressure screen to produce a soap-containing liquid having reduced fiber content to facilitate and intensify further treatment of the soap-containing liquid.

2. A method as recited in claim 1 wherein (a) is practiced using soap-containing black liquor directly from an alkaline digestion process as the soap and fiber containing liquid.

3. A method as recited in claim 1 wherein (a) is practiced using soap-containing black liquor from a digestion process as the soap and fiber containing liquid and further comprising (b) diluting the soap-containing liquid from an alkaline digestion process with other black liquor prior to practicing (a).

4. A method as recited in claim 3 wherein (b) is practiced to simultaneously raise the temperature of the soap-containing black liquor so that (a) is practiced on liquid at a temperature of at least 60° C.

5. A method as recited in claim 4 wherein (b) is practiced to simultaneously raise the temperature of the soap-containing black liquor so that (a) is practiced on liquid at a temperature of at least 70° C.

6. A method as recited in claim 4 wherein (b) is further practiced so that the soap portion is less than 50% by value of the total dry-solids volume of the liquid treated in (a).

7. A method as recited in claim 1 wherein (a) is practiced with the liquid at a temperature of at least 60° C.

8. A method as recited in claim 1 wherein (a) is practiced using brown stock wash filtrate as the soap and fiber containing liquid.

9. A method as recited in claim 1 wherein (a) is practiced using a combined stream of soap-containing black liquor from an alkaline digestion process and brown stock wash filtrate as the soap and fiber containing liquid.

10. A method as recited in claim 1 wherein (a) is practiced by screening in a pressure screen having a screen surface with holes 0.4 mm or less in diameter or slots 0.2 mm or less in width, to produce a soap-containing liquid having reduced fiber content.

11. A method as recited in claim 10 wherein (a) is further practiced so that soap passes through the holes or apertures and fibers pass along the screen surface.

12. A method as recited in claim 10 wherein (a) is practiced so that the soap content of rejects from the screen is about 70–75% of the soap content of the soap-containing liquid fed to the screen.

13. A method as recited in claim 1 wherein further comprising, after (a), (b) further treating the soap-containing liquid by evaporation and combustion, or tall oil production.

14. A method as recited in claim 1 further comprising, prior to (a), (b) passing black liquor from a continuous or batch alkaline pulping process to a separation tank to produce a soap fraction at the top of the tank, and practicing (a) using the soap fraction from (b); and wherein (a) is practiced using a pressure screen having a screen surface.

15. A method as recited in claim 14 wherein (a) is practiced by screening in a pressure screen having a screen surface with holes 0.4 mm or less in diameter or slots 0.2 mm or less in width, to produce a soap-containing reject liquid having reduced fiber content.

16. Apparatus for intensifying an alkaline cellulose pulping process, comprising:

a digester;

pulp washers operatively connected to said digester which wash pulp from the digester;

at least one soap separator which separates soap from soap and fiber-containing liquid from at least one of said digesters and said washers to produce a soap fraction containing fibers;

a discharge line from said soap separator, containing the soap fraction with fibers; and a pressure screen connected to said discharge line to separate fibers from soap containing liquid.

17. Apparatus as recited in claim 16 wherein said soap separators comprise a plurality of soap separating tanks; and further comprising a pump connected between at least one of said tanks and said pressure screen.

18. Apparatus as recited in claim 17 wherein at least two of said tanks have discharge lines connected to said pressure screen so that said pressure screen treats soap fractions from said at least two tanks at the same time.

19. Apparatus as recited in claim 16 wherein said pressure screen comprises a screen surface having holes with a diameter of 0.4 mm or less.

20. Apparatus as recited in claim 16 wherein said pressure screen comprises a screen surface having slots with a width of 0.2 mm or less.

* * * * *